United States Patent [19]

Wong et al.

[11] Patent Number: 4,825,953

[45] Date of Patent: May 2, 1989

[54] WELL SERVICING SYSTEM

[75] Inventors: Kwok-Ping Wong, The Colony, Tex.; Peter Cowan, Montrose, Angus, Scotland

[73] Assignee: Otis Engineering Corporation, Dallas, Tex.

[21] Appl. No.: 202,361

[22] Filed: Jun. 6, 1988

Related U.S. Application Data

[63] Continuation-in-part of Ser. No. 151,112, Feb. 1, 1988, abandoned.

[51] Int. Cl.[4] ..... E21B 29/04

[52] U.S. Cl. ..... 166/338; 166/54.5; 166/356; 166/363; 166/364

[58] Field of Search ..... 166/54.5, 54.6, 338, 166/340, 344, 352, 356, 363, 364, 355

[56] References Cited

U.S. PATENT DOCUMENTS

| | | | |
|---|---|---|---|
| 2,825,536 | 3/1958 | Kenneday et al. | 166/54.5 |
| 2,919,111 | 12/1959 | Nicolson | 166/364 |
| 3,766,978 | 10/1973 | Orund et al. | 166/363 |
| 4,024,718 | 5/1977 | Roche et al. | 166/355 |
| 4,653,776 | 3/1987 | Borg | 166/363 |
| 4,673,041 | 6/1987 | Turner et al. | 166/340 |
| 4,718,487 | 1/1988 | Lanmon, II | 166/84 |

OTHER PUBLICATIONS

SPE 16570, "A Complete Subsea Wireline System", Manzi et al., Sep. 1987.

*Primary Examiner*—Stephen J. Novosad
*Assistant Examiner*—Terry Lee Melius
*Attorney, Agent, or Firm*—Roland O. Cox

[57] ABSTRACT

Disclosed is a wireline well servicing system for underwater wells utilizing a lubricator stack having upper and lower sections connected by a remotely operable connector. The lower lubricator section includes a remotely operable valve connectable to a wellhead and a stress joint connected on the valve. The valve may be closed to retain pressure control of the well if the stress joint is fractured in bending by side loading on the lubricator stack. The upper lubricator section includes a remotely operable wireline clamp and cutter unit on a stuffing box. The clamp and cutter are remotely operable by the same control conduit to quickly clamp and cut the wireline to permit emergency removal of the surface service vessel. After the service vessel has moved back into working position above the underwater well, wireline servicing operations may be continued by latching onto the clamp cutter unit with a pulling tool on wireline from the vessel, and lifting the clamp cutter unit while pulling the cut wireline through the stuffing box until the tools attached to the wireline reach top in the upper lubricator section. The upper lubricator section is disconnected from the lower section and lifted to the vessel to prepare the clamp and cutter unit for further operation and replace the cut wireline with continuous line.

39 Claims, 3 Drawing Sheets

WELL SERVICING SYSTEM

This application for United States Patent is a continuation-in-part of our co-pending application Ser. No. 07/151,112, filed Feb. 1, 1988 now abandoned.

BACKGROUND OF THE INVENTION

This invention relates to well servicing systems. The invention particularly relates to a system utilizing wireline well servicing techniques to service underwater wells.

U.S. Pat. No. 4,673,041, incorporated herein for reference, discloses a system and method for conducting wireline well servicing operations in an underwater well. This system requires disconnect and time-consuming retrieval of the upper lubricator stack section back to the floating service vessel before the vessel may be moved out of well servicing position above the underwater well in case of surface storms or other emergency.

Another well servicing system is described in paper number SPE 16570 entitled "A COMPLETE SUBSEA WIRELINE SYSTEM" published by Society of Petroleum Engineers, P.O. Box 833836, Richardson, Tex. 75083-3836. This system provides for cutting wireline at the surface to allow the service vessel to make an emergency move. Cutting wireline at the surface will permit any well servicing tools in the well servicing lubricator and the wireline to fall into and be lost in the well, resulting in difficult and expensive fishing operations in an underwater well before reentry and wireline servicing of the well may be continued.

SUMMARY OF THE INVENTION

The well servicing system of this invention utilizes a lubricator stack having upper and lower sections connected by a remotely operable connector. After the lubricator stack is connected to an underwater wellhead, a clamp and cutter on top of the upper lubricator section are used to clamp and suspend the wireline and wireline tools in the lubricator and cut the wireline for emergency removal of the surface vessel. Suspending the wireline and tools prevents them from falling into the well and being lost when the line is cut at the lubricator top. Cutting near the lubricator top permits up to over a thousand feet of wireline extending from the surface vessel to the wellhead lubricator to be retrieved back to the surface vessel. After the surface vessel returns to working position above the underwater well, the well may be reentered and wireline well servicing operations continued by latching onto a fishneck on the clamp cutter with a pulling tool on wireline from the surface vessel, retrieving the clamp cutter, which is still clamped to the cut wireline, back to the surface. The cut section of wireline is pulled through a stuffing box on the upper lubricator section, which was sealed around the wireline and has been retaining well pressure. The tools now have been pulled up into the lubricator permitting the well to be shut in and the upper lubricator section retrieved for replacement of the cut wireline with continuous wireline.

An object of this invention is to provide an underwater well servicing system in which the wireline may be cut to permit rapid emergency removal of the support vessel.

An object of this invention is to provide an underwater well servicing system in which the cut wireline and tools are prevented from falling into and being lost in the well.

An object of this invention is to provide an underwater well servicing system which includes a remotely operable wireline clamp and cutter operable by one control conduit to clamp then cut.

Another object of this invention is to provide a well servicing system wherein pressure control of the well can be maintained in the event the lubricator stack is fractured.

DESCRIPTION OF THE PREFERRED EMBODIMENTS

Figure 1:
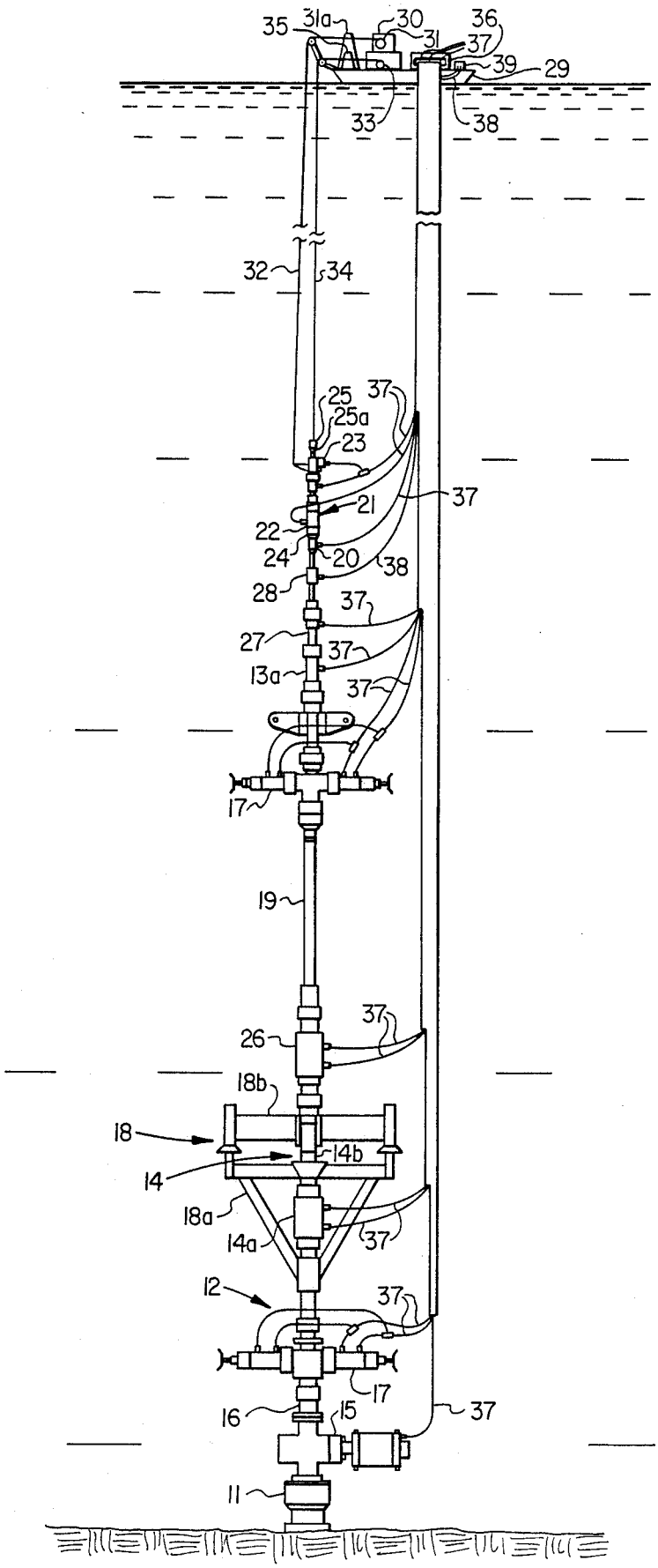
FIG. 1 is a schematic drawing of the well servicing system of this invention servicing an underwater well.

FIG. 1 shows a wireline lubricator stack 10 connected on an underwater wellhead 11. The lubricator stack has a lower section 12 and an upper section 13 connected by remotely operable stack section connector 14. The remotely operated connector of U.S. Pat. No. 4,667,986 may be used for connector 14.

The lower lubricator stack section includes a remotely operable valve 15, a stress joint 16, a remotely operable blowout preventer 17, the lower member **14*a* of the section connector 14 and a lower member 18*a* of guide frame 18. The stress joint may be connected above or below the blowout preventer. The valve 15** may be a fail close type valve or a valve which cuts wireline when closing.

The upper lubricator stack section includes the upper member **14*b* of the stack section connector, the upper section 18*b* of the guide frame, at least one lubricator section 19, a remotely operable wireline stuffing box 20 and a clamp and cutter unit 21, which includes a clamp 22 and a cutter 23. The clamp cutter unit is mounted on the wireline stuffing box with a bracket 24. A guide 25 is attached on the cutter to guide wireline into the unit. Guide 25 has fishing neck flange 25*a*. The upper section may also include a remotely operable tool trap 26, a remotely operable blowout preventer 17, a remotely operable rope socket catcher 13*a*, a chemical injector section 27 and a grease control section 28**.

Mounted on service vessel 29 is a wireline service unit 30 having a lift line winch 31 on which a lift line 32 is reeled and a vessel heave compensator **31*a* for the lift line. The lift line is threaded through the heave compensator and lift line and winch are used to lower and raise the lubricator stack and stack sections to and from the underwater wellhead. Also on the service vessel is a wireline winch 33 on which wireline 34 is reeled and a vessel heave compensator 35 for the wireline. The wireline is threaded through the heave compensator and through guide 25, clamp and cutter unit 21, stuffing box 20 and is connected to a wireline tool string in upper lubricator stack section 13**. The wireline winch provides constant tensioning for the wireline and is used to lower and raise the wireline and tool string to perform service operations in the well.

Also mounted on the service vessel is a source of pressured fluid 36 and a number of conduits 37 are connected between source 36 and the remotely operable components in the lubricator stack to supply pressured fluid and return it if required to the source for remote operation of these components. A single conduit is required to furnish pressured fluid to clamp cutter unit 21. When remotely operated, the clamp clamps the wireline passing through the unit first and with increased fluid pressure in the conduit, the cutter operates second to cut the wireline. A conduit 38 is connected between a source of grease 39 on the service vessel and grease control section 28. There is a power operated shear device (not shown) for each conduit on the service vessel, which can cut each conduit when operated. The clamp cutter unit and the grease control section each require only a supply conduit and not a return to source conduit.

Figure 4:
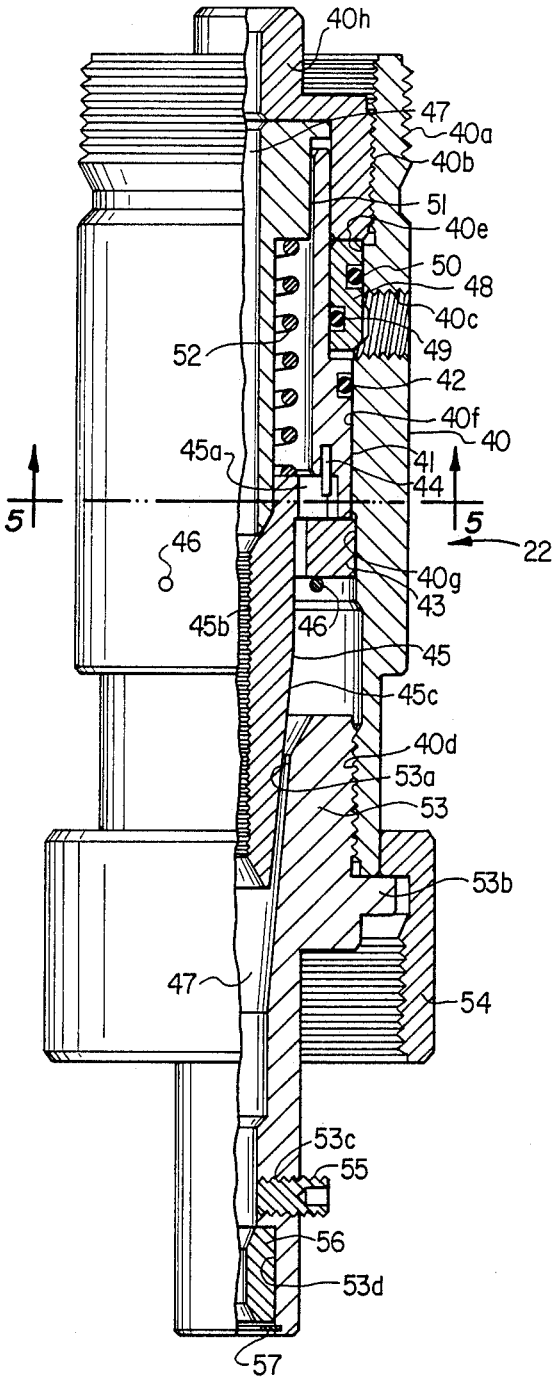
FIG. 4 is a half sectioned drawing in elevation of the wireline clamp used in the well servicing system of this invention.
Figure 5:
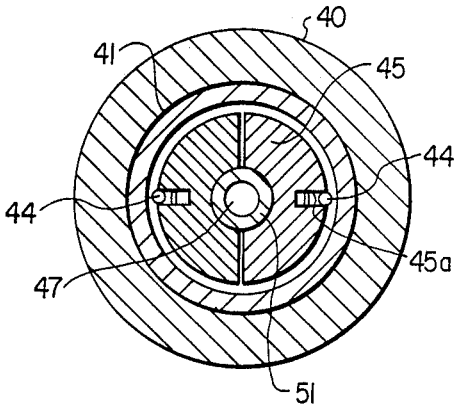
FIG. 5 is a drawing of a cross section of the clamp along line 5—5 of FIG. 4.

FIG. 4 shows the clamp 22 of the clamp cutter unit, which is remotely operated to clamp the wireline suspending it and wireline tools attached in the lubricator stack before the wireline is cut. The clamp has a housing 40 which has threads 40*a*, 40*b*, 40*c* and 40*d* and bores 40*e*, 40*f*, and 40*g*. Thread 40*a* is used to connect clamp 22 to cutter 23. A conduit 37 is connected in thread 40*c*. A piston 41 with pins 44 is slidably mounted and sealed in bore 40*f* with resilient seal 42 forming a variable volume pressure chamber with the housing. A ring 43 is slidably mounted in bore 40*g* (See also FIG. 5). Pins 44 protrude into slots 45*a* in a flange on wedge segments 45 to maintain radial position of the segments. Each wedge segment has a friction surface 45*b* and a camming surface 45*c*. Teeth are shown cut into surface 45*b* which will penetrate and stop line when segments 45 are in clamping position. Sufficient roughness of surface 45*b* to stop line may also be obtained by rough machining, coating or plating. Shear pins 46 retain ring 43 and wedge segments 45 in the up position not clamping wireline passing through passageway 47 in clamp 22. Slidably mounted around the piston and in bore 40*e* is a seal sleeve 48, which is sealed to the piston with resilient seal 49 and sealed in the bore with resilient seal 50. Mounted in the piston around wedge expander 51 is a compressed spring 52. The wedge expander and seal sleeve are retained in position by an upper guide 40*h* connected in housing thread 40*b*. Connected in housing thread 40*d* is a lower housing 53 having a camming surface 53*a*, a flange 53*b*, a thread 53*c* and a bore 53*d*. A threaded collar 54 useful for connecting the clamp 22 to bracket 24 is retained around housing 40 by flange 53*b*. A set screw 55 is connected in thread 53*c* and a wireline guide 56 is retained in bore 53*d* by retaining ring 57. Set screw 55 may be used as a manual wireline clamp.

Figure 2:
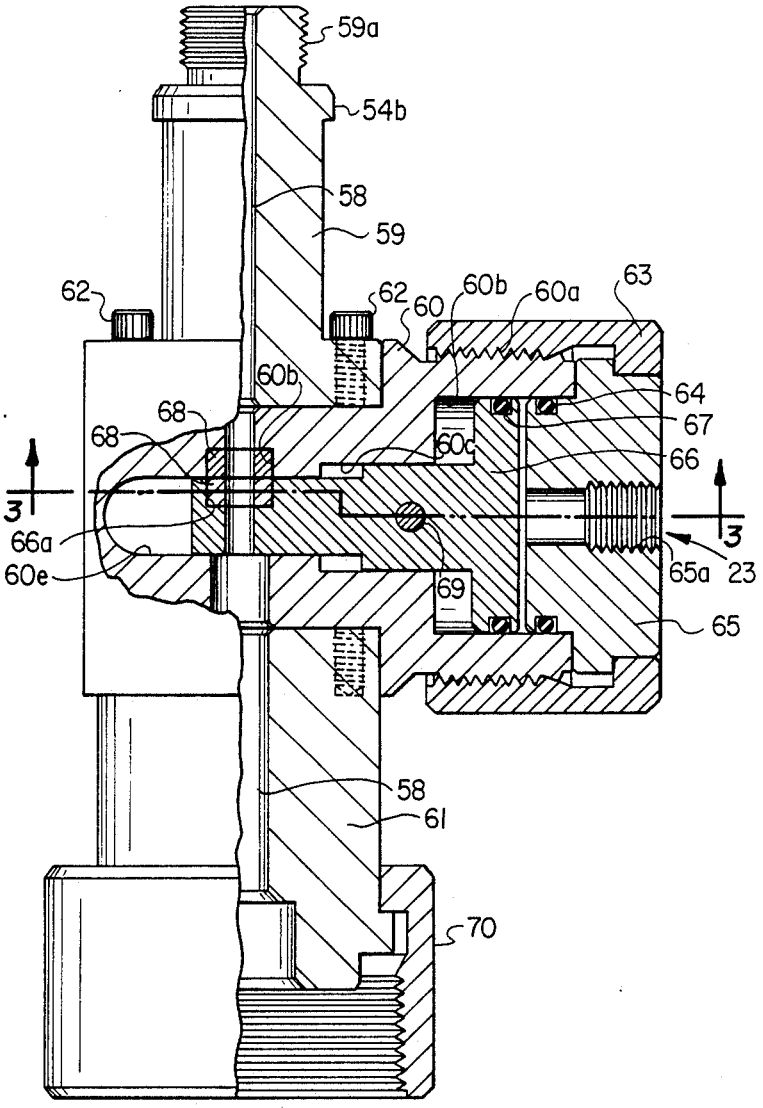
FIG. 2 is a partially sectioned drawing in elevation of the wireline cutter used in the well servicing system of this invention.
Figure 3:
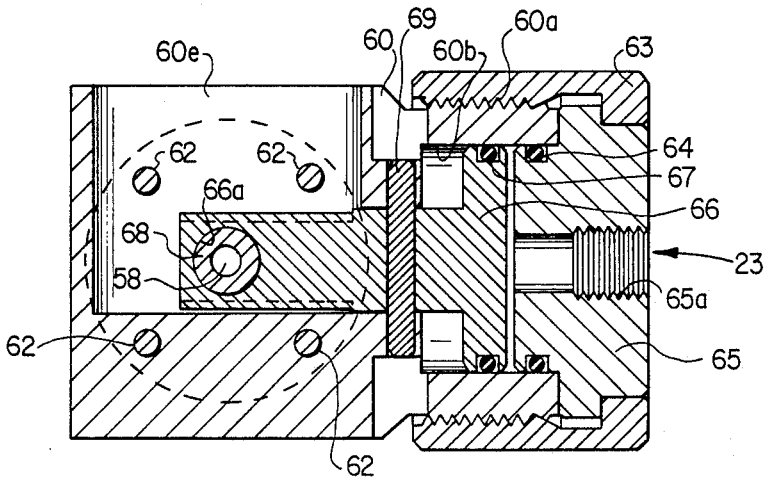
FIG. 3 is a drawing of a cross section of the cutter along line 3—3 of FIG. 2.

FIG. 2 shows the remotely operable wireline cutter 23 used in the well servicing system of this invention to cut the wireline after the clamp has been operated. The cutter has a passageway for wireline 58 and an upper body 59. The upper body has a thread 59*a*, a fishing neck flange 59*b*. Guide 25 is connected to the cutter by thread 59*a*. The upper body is connected to clamp housing 60 and lower body 61 by bolts 62 (See also FIG. 3). Housing 60 has a thread 60*a*, a bore 60*b*, a bore 60*c*, a bore 60*d* and a slot 60*e*. A collar 63 is connected to housing 60 by thread 60*a*, and positions a resilient seal 64 on cap 65 sealingly engaged in housing bore 60*b*. The cap has a thread 65*a* for connection of the conduit supplying pressured fluid to the clamp and cutter unit 21.

Slidably mounted in cutter housing 60 is a piston 66, which is sealed in bore 60*b* with resilient seal 67 forming a variable volume pressure chamber with the housing and cap. Housed in a flat bottomed bore 66*a* in the piston is a cutting insert 68. A cutting insert 68 is also housed in flat bottomed bore 60*d* in the cutter housing. The lower face of the housing insert is in slidable contact with the upper face of the piston insert. A shear pin 69 passes through holes in the housing and a hole in the piston retaining the piston in a position not cutting wireline. Flanges 61*a* on the lower body retain a threaded collar 70 which is used to connect the cutter 23 to the clamp 22.

To use the wireline system of this invention, the service vessel 29 is positioned above the underwater wellhead 11, as shown in FIG. 1. Pressured liquid conduits 37 are connected to the remotely operated components in the lower lubricator stack section 12 and this section is lowered by line 32 and line winch 31 from the service vessel to the underwater wellhead and connected. On the deck of the service vessel, wireline 34 is threaded through the vessel heave compensator 35, upper lubricator stack section cutter and clamp unit 21, stuffing box 20 and connected to a string of wireline tools, which are pulled back into the upper stack section. Required pressured liquid and grease conduits 37 and 38 are connected to components in upper lubricator stack section 13. The upper stack section is then lowered to the wellhead with the line winch and guided to and connected to the lower stack section on the wellhead by connecting remotely operable connector members 14*b* and 14*a*.

Wireline operations are then conducted to service the well. During wireline operations, the stuffing box 20 may be remotely operated to seal around the wireline as required and section connector 14 may be operated to disconnect the upper lubricator stack section 13 from the lower section 14 and raise the upper section with connected conduits and the wireline tool string back to the vessel deck and to reconnect the upper section to the lower section on lowering the upper section back to the lower section for reconnection of section connector 14.

If the section connector 14 is the connector of U.S. Pat. No. 4,667,986 having an internal pressure responsive safety lock, internal pressure must be bled from the lubricator stack before the section connector may be remotely operated to disconnect.

Also while conducting wireline operations in the well, blowout preventer 17 may be remotely operated as required. If the stress joint 16 is fractured by side loading while the lubricator stack is connected to a wellhead, valve 15 may be remotely operated to close to prevent an underwater blowout, and to maintain pressure control of the well. The stress joint is designed to fail in bending before the wellhead is damaged.

If the upper lubricator stack section includes a remotely operable tool trap, the trap may be operated as needed while performing wireline operations. If there is a rope socket catcher in the upper stack section, this catcher may be operated as needed while servicing the well. If there is a remotely operable blowout preventer in the upper section, the preventer may be operated as required. If a chemical injector section is included in the upper section, pressured chemical fluid may be injected into the lubricator as needed. If the upper section has a grease control section, pressured grease from conduit 38 may be forced into this section as needed while carrying out wireline operations in the well.

If an emergency disconnect from the lubricator stack is required for quick removal of the service vessel while performing wireline operations in the well and time permits, the wireline tools should be raised into the lubricator above the tool trap. If time does not permit raising the tools then pressure is increased in the single conduit 37 supplying fluid to the clamp cutter unit 21. This pressure acts through the conduit on the area sealed by seal 67 on piston 66 in cutter housing bore **60*b* shown in FIG. 2. This same pressure acts through the single conduit simultaneously on the area sealed by seal 42 on piston 41 in clamp housing bore 40*f* as shown in FIG. 4. Pressure on the clamp piston forces ring 43 downward placing a shearing load on pins 46. In the cutter, pressure on piston 66 tends to move the piston laterally and places a shearing load on pin 69. As less pressure is required to shear clamp pins 46 than cutter pin 69, the clamp pins shear first and piston 41 moves ring 43 downwardly from under the wedge segment flange permitting compressed spring 52 to push the wedge segments off expander 51 and further downward until segment camming surface 45*c* engages lower housing camming surface 53*a*. As the spring pushes the wedges further down, they are cammed inwardly until friction surfaces 45*b*** stop and clamp the wireline passing through the clamp and cutter, suspending the wireline and wireline tools.

Increasing pressure in the clamp and cutter conduit 37 will now shear cutter pin 69 and move cutter piston 66 and piston insert 68 in bore **60*e* laterally on housing insert 68** to shear and cut wireline passing through the clamp cutter unit and as the wireline and wireline tools were first clamped and suspended before cutting the wireline, the wireline and tools do not fall into the well. Next, the shear devices on the service vessel are operated to cut all conduits extending between the service vessel and the lubricator stack and the service vessel may be moved off location above the well.

Afterwards when the service vessel has moved back into servicing location above the well and control conduits have been reconnected to section connector 14, an overshot fishing tool lowered from the service vessel on wireline latches onto guide fishing flange **25*a*, the clamp cutter still clamped on the cut wireline and connected bracket 24 is lifted from stuffing box 20 and the cut wireline is pulled through the stuffing box (which has been sealed around the wireline retaining pressure in the well) until the cut wireline and tools are in the upper lubricator stack section. Connector 14** is then operated to disconnect and the upper lubricator stack section is retrieved to the deck of the service vessel and prepared for reattachment to the lower lubricator stack section on the wellhead and continuing wireline operations in the well by preparing the wireline clamp and cutter unit to be operated again and attaching continuous wireline to the wireline tool string.

What is claimed is:

1. A system for conducting wireline operations in an underwater well comprising:

(a) remotely operable valve means connectable to a wellhead for closing the well;

(b) remotely operable blowout preventer means connected to said valve means for maintaining pressure control of the well;

(c) lubricator stack means connected to said blowout preventer means, said stack means having a wireline tool string therein and includes a lower section having a remotely operable section connector member therein, and an upper section including a remotely operable section connector member therein, said upper section connector member releasably connectable to said lower section connector member, at least one lubricator section, remotely operable wireline stuffing box means for sealing around the wireline, and remotely operable hydraulic actuated wireline clamp means and cutter means for clamping and cutting the wireline;

(d) a floating vessel having mounted thereon lift line winch means for raising and lowering said lubricator stack means, wireline winch means for operating said wireline tool string in the well, a source of pressured fluid; and (e) control conduits for conducting pressured fluid from said pressured fluid source to said valve means, blowout preventer means, stuffing box, and one of said remotely operable section connector members, one of said control conduits conducting pressured fluid to said clamp means and said cutter means.

2. The system as defined in claim 1 wherein the operating pressures for and sequence of operation of the clamp means and cutter means may be predetermined.

3. The system as defined in claim 1 wherein a stress joint is connected to the blowout preventer means.

4. The system as defined in claim 1 wherein the lower and upper lubricator stack means sections each include guide frame means members for guiding and aligning said upper and lower section connector members for connection.

5. The system as defined in claim 1 wherein the valve means comprise a hydraulically operated valve and control conduits for conducting pressured fluid from the source of pressured fluid to said valve.

6. The system as defined in claim 5 wherein the hydraulically operated valve is a fail close type.

7. The system as defined in claim 5 wherein the valve will cut wire passing therethrough when operated to close.

8. The system as defined in claim 1 wherein the blowout preventer means comprise a remotely operable blowout preventer and control conduits for conducting pressured fluid from the pressured fluid source to said preventer.

9. The system as defined in claim 1 wherein the upper lubricator stack section includes a remotely operable tool trap and control conduits for conducting pressured fluid to said trap from the pressured fluid source.

10. The system of claim 1 wherein the upper lubricator stack section includes at least one lubricator section.

11. The system as defined in claim 1 wherein the upper lubricator stack section further includes remotely operable blowout preventer means therein.

12. The system as defined in claim 11 wherein the blowout preventer means comprise hydraulically operated blowout preventers and control conduits for conducting pressured fluid from the pressured fluid source to said blowout preventers.

13. The system as defined in claim 1 wherein the upper lubricator stack section includes a rope socket catcher and a control conduit for conducting pressured fluid from the pressured fluid source to said catcher.

14. The system as defined in claim 1 wherein the upper lubricator section includes means for remotely injecting chemicals therein.

15. The system as defined in claim 14 wherein the means for injecting chemicals in the upper lubricator stack section comprise:

(a) an injection section in the upper lubricator stack section;

(b) a source of pressured chemicals on the floating vessel; and (c) conduits for conducting chemicals from said source to said injection section.

16. The system as defined in claim 1 wherein the upper lubricator stack section includes means for remotely injecting grease therein.

17. The system as defined in claim 16 wherein the means for injecting grease into the upper lubricator stack section comprises:

(a) a grease injection section in the upper lubricator stack section;

(b) a source of pressured grease on the floating vessel; and (c) conduits for conducting said grease to said section.

18. The system as defined in claim 1 wherein the connected section connector members have means responsive to internal stack means pressure for locking said connector members connected.

19. The system as defined in claim 1 wherein the wireline winch means provides constant tensioning for the wireline.

20. The system as defined in claim 1 further including a vessel heave compensator for the wireline mounted on the floating vessel.

21. The system as defined in claim 1 including a vessel heave compensator for the lift line mounted on the floating vessel.

22. The system of claim 1 further including remotely operated connector means for connecting said valve means to an underwater wellhead, said valve means having control conduits for conducting pressured fluid from the pressure source to said valve means.

23. A system for conducting wireline operations in an underwater well comprising:

(a) a fail close type valve connectable to a wellhead, said valve remotely operable to cut wireline passing therethrough when operated to close;

(b) a stress joint connected to said valve;

(c) a remotely operable blowout preventer connected to said stress joint;

(d) a lubricator stack connected to said stress joint and having a wireline tool string therein, said lubricator stack including a lower section having a remotely operable section connector member therein, and an upper section having therein a remotely operable section connector member, said section member releasably connectable to said lower section connector member, a remotely operable tool trap, one or more lubricator sections, a remotely operable blowout preventer, a remotely operable rope socket catcher, a remotely operable chemical injection section, a remotely operable grease injection section, a remotely operable wireline stuffing box, a remotely operable wireline clamp and cutter on said stuffing box;

(e) a floating vessel having mounted thereon a lift line winch having line thereon, a wireline winch having wireline thereon, said wireline winch providing constant tensioning for the wireline, a vessel heave compensator for the lift line, a vessel heave compensator for the wireline, a source of pressured fluid, a source of pressured chemicals, a source of pressured grease; and (f) control conduits for conducting pressured fluid from said pressured fluid source to said remotely operable valve, blowout preventers, section connector member, tool trap, rope socket catcher and wireline stuffing box, control conduits for conducting pressured grease to said grease section, control conduits for conducting pressured chemicals to said chemical section and one conduit for conducting pressured fluid to said wireline clamp and cutter.

24. The system as defined in claim 2 wherein the remotely operable clamp means has a passage for wireline therethrough and comprises:

(a) a housing having a camming surface therein;

(b) means for clamping wireline mounted in said housing, said means longitudinally moveable to a position clamping said wireline;

(c) biasing means for biasing said clamping means toward clamping position;

(d) releasable means for retaining said clamping means in said position not clamping wireline; and (e) piston means slidably and sealably mounted in said housing for releasing and moving said clamping means to a position clamping said wireline.

25. The system as defined in claim 23 wherein the means for clamping wireline comprise:

wedge segments having a bore, friction surface in said bore, a flange on each segment and a slot through each flange, and a camming surface on each segment engageable with the camming surface in the housing.

26. The system of claim 25 wherein the segment friction surface has teeth thereon.

27. The system of claim 25 wherein the segment friction surface is coated.

28. The system of claim 25 wherein the segment friction surface is plated.

29. The system of claim 25 wherein the segment friction surface has a rough finish.

30. The system as defined in claim 23 wherein the piston means comprise:

(a) a ring positioned and sealed in the housing bore;

(b) a piston slidably and sealably mounted in said ring and said housing bore, said piston forming a variable volume chamber with said housing and said ring; and (c) an inlet in the clamp housing for conducting pressured fluid to said chamber.

31. The system as defined in claim 23 wherein the releasable means comprise:

(a) a shear ring around the wedge segments below the wedge segment flanges; and (b) shear pins through the clamp housing below said shear ring.

32. The system as defined in claim 30 wherein the releasable means further include means radially positioning the wedge segments comprising pins in the piston protruding into the segment flange slots.

33. The system as defined in claim 23 wherein the remotely operable clamp means further includes means for manually clamping the wireline comprising a screw threaded laterally into the clamp housing below the camming surface in said housing for manually clamping the line.

34. The system as defined in claim 32 wherein the remotely operable clamp means further includes guiding means for guiding and centering the wireline passing through the clamp means comprising:

(a) an upper guide in the clamp housing; and (b) a lower guide mounted in the clamp housing below the manual clamping screw.

35. The system of claim 2 wherein the remotely operable cutter means comprises:

(a) body means having a passage for wireline therethrough, said body means including an upper body having a fishing flange connected to an intermediate body connected to a lower body having a connection thereon; and (b) remotely operable means mounted in said intermediate body for cutting wireline in said passage including a variable volume pressure chamber having piston means and an inlet therein, said piston means moveable laterally to a position cutting wireline, and releasable means for retaining said piston means in a position not cutting wireline.

36. The system of claim 34 wherein the piston means comprise:

(a) a piston having a passage for wireline therethrough slidably mounted in the intermediate body; and (b) a resilient seal sealing said piston in said body.

37. The system of claim 35 including a cutting insert in the piston around the wireline passage, said insert shearably cooperable with a second cutting insert in the intermediate body around the wireline passage.

38. The system of claim 34 wherein the releasable means comprise a shearable pin passing through the intermediate body and piston.

39. The system as defined in claim 2 wherein pressure in the clamp and cutter means control conduit operates said clamp means to first clamp the wireline at a first lower pressure and operates said cutter means to cut said wireline at a second higher pressure.

* * * * *